United States Patent [19]

Petrosky

[11] 4,229,889

[45] Oct. 28, 1980

[54] PRESSURIZED POROUS MATERIAL CUSHION SHOE BASE

[76] Inventor: Charles Petrosky, 1118 N. Jefferson St., Arlington, Va. 22205

[21] Appl. No.: 913,149

[22] Filed: Jun. 6, 1978

Related U.S. Application Data

[63] Continuation-in-part of Ser. No. 678,658, Apr. 20, 1976, Pat. No. 4,129,951.

[51] Int. Cl.[2] ..... A43B 13/18; A43B 13/20

[52] U.S. Cl. ..... 36/28; 36/29; 36/43

[58] Field of Search ..... 36/29, 28, 43, 44, 3 R, 36/3 B, 14

[56] References Cited

U.S. PATENT DOCUMENTS

| | | | |
|---|---|---|---|
| 3,087,262 | 4/1963 | Russell | 36/28 |
| 3,447,251 | 6/1969 | Drexler | 36/14 |
| 3,795,994 | 3/1974 | Ava | 36/29 |
| 4,008,530 | 2/1977 | Gager | 36/28 |

FOREIGN PATENT DOCUMENTS

| | | | |
|---|---|---|---|
| M 24564 | 3/1956 | Fed. Rep. of Germany | 36/14 |
| 1015347 | 9/1957 | Fed. Rep. of Germany | 36/28 |
| 2460034 | 6/1976 | Fed. Rep. of Germany | 36/29 |
| 822697 | 9/1937 | France | 36/14 |
| 1034365 | 4/1953 | France | 36/14 |
| 1164720 | 5/1958 | France | 36/29 |
| 832324 | 4/1960 | United Kingdom | 36/14 |

*Primary Examiner*—James Kee Chi

*Attorney, Agent, or Firm*—James Creighton Wray

[57] ABSTRACT

An air cushion shoe base has a sole and a vertical rim within which is filled in air tight relation with foam rubber which is tightly covered by an insole. The foam rubber forms small metering orifices for restricting and delaying fluid flowing forward and rearward in response to weight shifts of a foot. A valve is provided within the rim, and the valve has a central body with a long valve orifice and lateral extensions for joining the body to an inside of the rim. The shoe base is filled to a desired pressure which is maintained periodically through the valve. A T-shaped welt extends around an upper peripheral area of the rim and insole for joining the cushion base to a shoe upper.

10 Claims, 7 Drawing Figures

FIG. 1
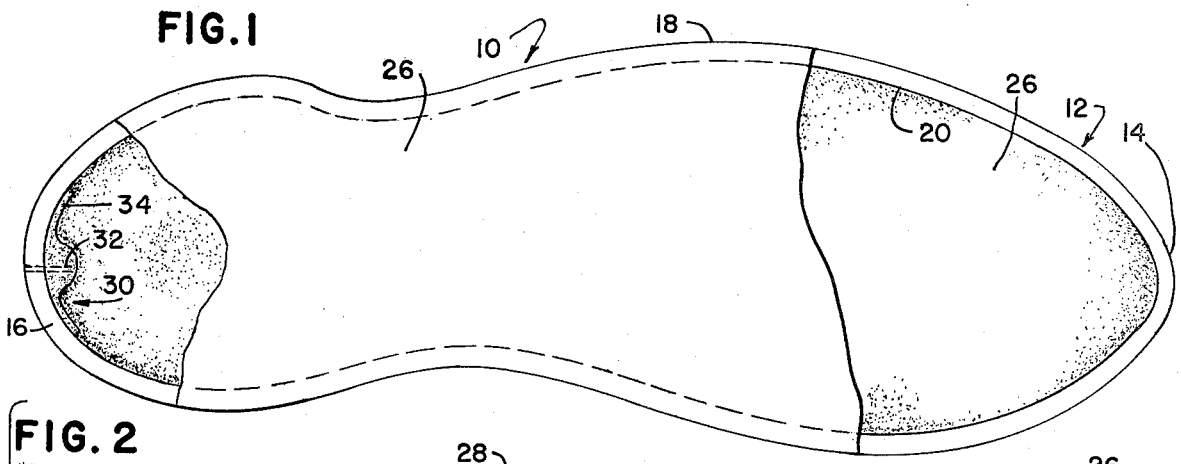
FIG. 2
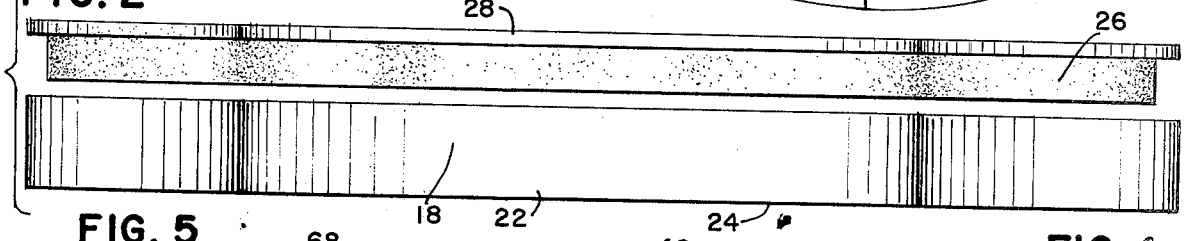
FIG. 5
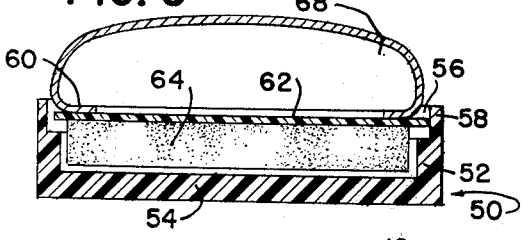
FIG. 4
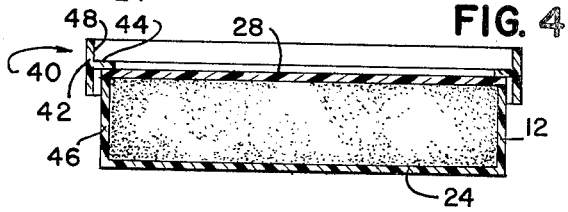
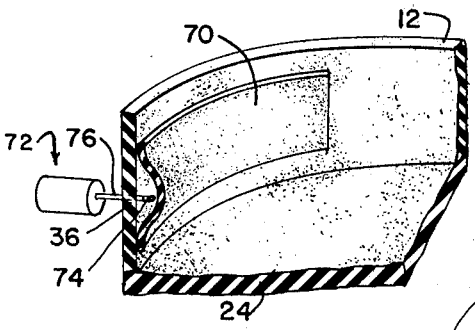
FIG. 7
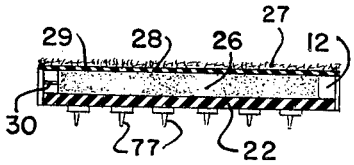
FIG. 6
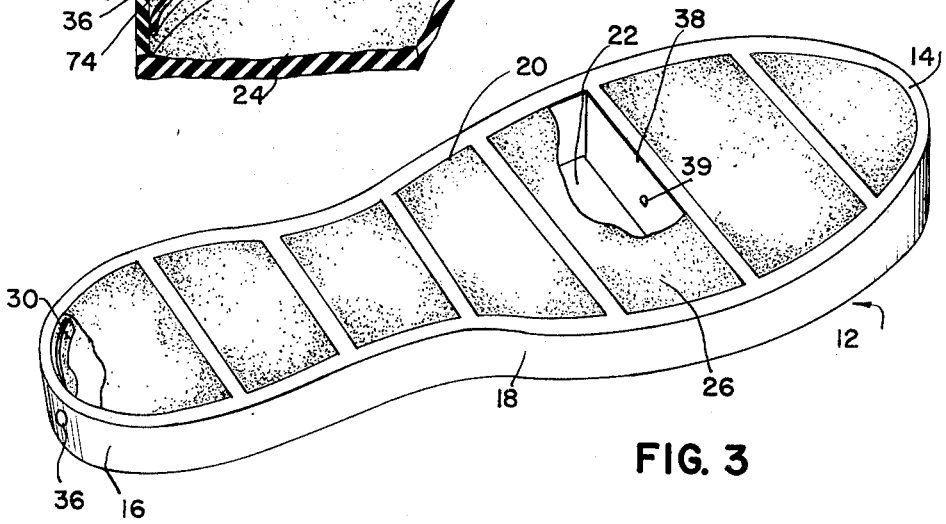
FIG. 3

PRESSURIZED POROUS MATERIAL CUSHION SHOE BASE

This is a continuation-in-part of patent application 678,658 filed Apr. 20, 1976, by Charles Petrosky, now U.S. Pat. No. 4,129,951.

BACKGROUND OF THE INVENTION

For people who must be on their feet for a long period of time, whether standing still, walking or running, thick soles are extremely useful. Cushion soles are particularly desirable, but some cushion soles have disadvantages of incorrect flexibility, unnatural feelings, or heavy weight.

Some soles which are filled with a pressurized fluid have problems of stability or problems of uniformly filling areas of the sole. In some devices, if a pressurized sole or a pressurized portion of the sole leaks, the sole may become unusable.

SUMMARY OF THE INVENTION

The present invention is a shoe base which has a sole, a rim extending upward from a periphery of the sole, and an insole secured to the top of the rim. Foam rubber fills the cavity and air is metered and stored as it flows forward and backward through the foam rubber as one walks or shifts weight.

In one embodiment of the invention, the sole and rim are integrally formed. Preferably the sole is relatively thick and the rim is relatively thin. The sole and rim may be formed of a uniform or non-uniform thickness rubber or utethane or other suitable material. Adjacent surfaces of the rim, sole, insole and foam rubber are integrally formed or are bonded or welded in air tight relationship. In one form of the invention a strip rim, the sole, inside and foam rubber are integrally bonded and a layer of sealing rubber is added around the outer sides.

A valve is placed in the rim near the orifice which extends through the rim, and the valve has an enlarged central body in a preferred embodiment, with a valve orifice extending through the central body and being inwardly closed by the body and by air pressure acting on the outside of the body. The body has wings which extend laterally along the inside of the rim and which are secured with the body to the rim. The cushioned base is filled by inserting a filling needle through the orifice and valve and flowing air through the needle, thereby slightly expanding the valve body and admitting air to the interior of the cushion base while preventing escape of air around the needle by tightly gripping the needle with the valve body. In a preferred form of the invention the shoes' base is continuously filled with air at controlled pressure greater than ambient pressure. The high pressure air flows back and forth through pores in the foam rubber as one moves of shifts weight.

Preferably foam rubber is tightly sealed to all interior surfaces. Alternatively the foam rubber may be surrounded with a fluid-impervious surface skin and filled with fluid. Preferably the fluid is a compressible fluid at a pressure differing from ambient pressure. Preferably the pressure is higher than ambient pressure. In a preferred form of the invention, a valve is provided in the impervious wall which surrounds the fluid in the foam rubber so that the foam rubber may be filled, adjusted and returned to the desired pressure.

In the preferred embodiment the exterior walls which downwardly and laterally confine the fluid filled foam are relatively less flexible than is the upper wall or insole portion. Preferably a sole and lateral rim confine outward movement of the fluid filled foam.

Foam rubber is preferred. Other materials, natural or man-made materials having pores capable of holding metering and transferring fluid may be suitable. Preferably open cell foam materials are employed.

In a preferred embodiment of the invention, a T-shaped welt is added to the top of the cushion base and the inner and lower sides of the welt are secured to the base while the upper and inner sides of the welt are secured to a shoe upper. Preferably the welt is extruded and ends of the welt are feathered and welded to form an integral annular welt.

In one form of the invention, the insole is flat and is welded to upper surfaces of the rim and the foam core.

In another form of the invention, the rim and sole are integrally formed, and the insole and foam core are integrally formed with the insole as an impervious skin on the foam. The bottom surface of the core and the lower periphery of the insole are welded to the rim.

In the preferred embodiment, the sole and rim flex longitudinally and somewhat laterally, and the core and insole flex to a greater degree, both longitudinally and laterally.

In a preferred embodiment, the core is substantially filled with air slightly above ambient pressure, and the base may be considered suitably filled when the insole has slight upward curvature. Stepping on the base in that condition slightly deforms the insole in the areas of maximum pressure and forces air through the metering pores in the core to conform the insole to the bottom of the foot. When one stands still over a long period of time, the insole becomes substantially configured according to the bottom of one's foot and to the pressure on various parts of the foot. As one walks, air leaks slowly through the metering pores to the other sections of the core. As one walks rapidly, little air is permitted to transfer, because of the rapid movement, and the slow transfer by the pores, and one has the feeling of a soft but stable sole.

One object of this invention is the provision of an air cushion shoe base having a flexible floor-contacting sole, a flexible foot-contacting insole positioned above the sole, a rim extending around a periphery of the sole and insole for connecting the sole and insole in airtight relationship, and a flexible foam core extending across the rim between the sole and the insole for dividing the shoe base into plural inflatable cells or compartments, each of the cells having small metering pores for flowing air through the pores from one section to another section, and means joining the sole, the rim, the insole and the core in air tight relationship.

Another object of the invention is the provision of a cushion shoe base having a one-way valve positioned on a rim between a sole and insole for admitting pressurized air through the one-way valve into a section of a core adjacent the valve and into subsequent sections through restricted metering pores.

The invention has as another object the provision of a cushion shoe base with a one-way valve having a central valve body with a valve orifice extending through the body and means to close the valve orifice contained in the body and mounting means and the body being attached to an inner wall of a rim sealing a sole and insole.

A further object of the invention is the provision of a pneumatic cushion shoe base with a sole constructed of rubber or urethane or other suitable material having a first thickness, a rim constructed of a rubber or urethane material having thicknesses less than the first thickness.

Another object of the invention is the provision of a welt connected to an insole and to a sole rim and having a T-shaped cross section with a relatively long cap portion extending around the rim and extending above the rim, and the T-shaped cross section having a leg portion extending inward over the insole.

A further object of this invention is the provision of a cushion shoe base with a sole, rim and core constructed of a rubber or urethane and with an insole adhered to upper surfaces of the rim and core.

Another object of the invention is the provision of a shoe base sole and rim constructed of unitary rubber or urethane or other suitable material, a foam rubber core joined to the insole, with lower surfaces of the core welded to the sole and lateral surfaces of the core welded to the rim, and an insole welded to an upper portion of the rim.

These and further objects and features of the invention are apparent in the foregoing and ongoing descriptions and in the drawings.

BRIEF DESCRIPTION OF THE DRAWINGS

FIG. 1 is a plan view partially cut away, showing the cushion shoe base of the present invention.

FIG. 2 is an exploded view of the shoe base as shown in FIG. 1.

FIG. 3 is a perspective view of a modified shoe base with the insole removed.

FIG. 4 is an end section showing the preferred welt of the present invention.

FIG. 5 is an end section showing an alternate form of the invention.

FIG.6 shows a cross sectional detail of the invention.

FIG. 7 shows a preferred form of valve.

DETAILED DESCRIPTION OF THE DRAWINGS

Referring to FIG. 1, a shoe base is generally indicated by the numeral 10. The shoe base has a rim 12 with a toe portion 14 and heel portion 16. The outer wall 18 of the rim is substantially smooth, as is the inner wall 20. The sole 22 is integrally formed with the rim 12 in a preferred form of the invention. The lower surface 24 of the sole may be porous or roughened to prevent the base from slipping while one is walking.

A core 26 having a plurality of cells and pores lies across the top of the sole 22 between opposite inner surfaces 20 of rim 12. In a preferred embodiment of the invention, the core 26 is foamed in place within the sole 22 and rim 12. Alternatively, the core 26 is bonded or welded to sole 22 and inner surface 20 of rim 12 such as by an adhesive bonding which insures a complete surface seal. Sole 22 and rim 12 are relatively thick for long wear and for stability. The core 26 promotes the stability of the base, but has sufficient pores so that the core is substantially unfelt by the wearer.

The cells and pores in core 26 divide the base into several longitudinally spaced sections which are filled with air. Insole 28 is joined to upper surfaces of core 26 and rim 12 to complete the air tight pockets within the core.

A filling valve 30 is provided at the heel portion 16 of the rim. Valve 30 has a bulbous main body with a central valving orifice 32 which is held closed by forces of the main body of valve 30. Inserting a conventional filling needle into the valve 30 through orifice 32 communicates the holes in the distal end of the needle with the air space and tightly seals the needle with walls of the resilient orifice 32. When the needle is withdrawn, the main body resiliently returns the orifice to its closed condition, and elevated air pressure within the base presses on the semicylindrical wall to further seal the opening. Wings 34 on the valve body are adhesively connected to the inner surface of the rim 12.

As shown in FIG. 3, an orifice 36 extends through rim 12 into the main body of the valve 30. Pores in core 26 slow passage of fluid between sections. Partitions 38 having aligned central metering orifices extend across the rim in air tight relation with the sole and insole and divide the foam rubber 26 into sections. Air is metered in distribution both by openings 39 in partitions 38 and by pores in the foam material 26.

As shown in FIG. 4, a preferred form of attaching the base to a shoe comprises a welt 40 having a T-shaped cross section. The vertical cap portion of the T-shaped cross section 42 lies along an upper portion of rim 12 and along a lower portion of the shoe upper. The stem portion 44 of the T-shaped cross section overlies the insole 28 and underlies an edge of the shoe upper. Preferably, the welt 40 is welded or adhesively bonded at its inner surface 46 and at the lower surface of central portion 44 to rim 12 and insole 28. The inner surface 48 of the upper portion of welt 40 and the upper surface of inward extending portion 44 are bonded or stitched to a conventional shoe upper.

An alternate form of the invention is shown in FIG. 5. There, the shoe base 50 has an integrally formed rim 52 and sole 54. A shelf 56 on an upper portion 58 of rim 52 receives outer edges 60 or an insole 62. Core 64 is integrally formed with the insole or is welded or adhesively bonded to the bottom of the insole. Metering pores in the core control the flow of fluid between sections of the core.

The partitions and insole are shown spaced from the rim and sole for clarity. In actual practice, the elements are formed with close tolerances so that they may be welded by heating or by applying solvents or adhesives to edges immediately before they are joined.

As shown in FIG. 5, a conventional shoe upper represented by element 68 is bonded to upper outward surfaces of the insole 62 and to inner surfaces of upper portions 58 of the rim 52.

In one embodiment, the shoe base rim, sole and core are integrally formed, with the sole rim and insole formed as skins on the foam. Valve body 30 is joined to the inner wall of the rim.

FIG. 6 shows a cross section of one embodiment. Rubber sole 22 supports a rim 12. Thin rubber partitions 38 extend transversely, dividing the base into plural air-tight sections. Aligned metering ports 39 communicate air between the sections. Foam rubber core 26 is divided into sections and is surfacebonded therein. Insole 28 with felted material 27 bonded thereto is surface bonded to the top of core 26, partitions 38 and rim 12. Alternatively, partitions 38 may upwardly terminate short of the inside to encourage air to flow between sections through the pores at the top of the one-piece core 26. A rubber coating 29 surrounds the sides. Air valve 30 completes the assembly.

The apparatus is filled and maintained at desired elevated pressure through valve 30. Air is transferred longitudinally slowly through pores in core 26. In a preferred form of valve, as shown in FIG. 7, a thin flexible rubber strip 70 is glued over needle orifice 36 on the inside of rim 12 with a non-drying glue. Needle 72 is inserted through the opening so that holes 74 are inside rim 12. Needle shaft 76 stretches and tightly seals orifice 36. Air pressure from needle 72 builds up between rim 13 and strip 70 pulling a small part of strip 70 away from rim 12 against attraction of the glue and the force of air pressure within the shoe base. When air pressure from the needle is greater than pressure within the shoe and attraction of the glue and stretching of the rubber strip, a small path forms across rubber strip 70 and releases air into the body of the shoe base. Pressure within the shoe, resilience of the strip, and the glue combine to retract the strip and force it into sealing relationship with the rim, as pressure from needle 72 falls. Withdrawal of the needle from orifice 36 allows the whole strip to be pressed lightly to the rim.

In one form of the invention, the fluid impervious nature inner cavity of the shoe base permits constructing the outer sole and rim out of porous light weight, highly flexible materials, for example, crepe rubber. The inner cavity is surrounded with an impervious membrane formed in situs to thoroughly bond the foam rubber to all surfaces that it encounters. Additionally, the rim may be formed of light porous material and the outer sole may be formed of air tight material, in which case an outer layer of settable air tight rubber around the rim gives a desired double air tight seal.

The invention is particularly desirable for use in sports shoes and especially golf shoes as noted by spikes 77 in FIG. 6.

While the invention has been described with reference to specific embodiments, it will be obvious to those skilled in the art that variations and modifications of the invention may be constructed without departing from the scope of the invention.

What is claimed is:

1. An air cushion shoe base comprising a flexible sole for contacting the floor, a flexible insole positioned above the sole for contacting a foot of a wearer, a rim extending around a periphery of the sole and insole for connecting the sole and insole in airtight relationship, and a flexible porous core of a foam material having cells and fine pores extending across the rim between the sole and the insole for dividing the shoe base into plural small inflatable compartments each filled with foam material, each compartment having small metering pores for flowing fluid through from one section to another section of the core and means joining the sole, the rim, the insole and the core in airtight relationship.

2. The cushion shoe base of claim 1 further comprising a one-way valve positioned on the rim for admitting pressurized fluid through the one-way valve into a section adjacent the valve.

3. The cushion shoe base of claim 2 wherein the one-way valve comprises a central valve body with a valve orifice extending through the body and means to close the valve orifice contained in the body and mounting means extending laterally from the body, the mounting means and the body being attached to an inner wall of the rim.

4. The cushion shoe base of claim 1 wherein the sole is constructed of a rubber or urethane material having a first thickness, wherein the rim is constructed of a material having a second lesser thickness, and wherein the insole is constructed of material having thicknesses less than the first and second thicknesses.

5. The cushion shoe base of claim 1 further comprising a welt connected to the insole and to the rim, the welt having a T-shaped cross section with a relatively long cap portion extending around the rim and extending above the rim, and the T-shaped cross section having a leg portion extending inward over the insole.

6. The cushion shoe base of claim 1 wherein the sole, rim and core are constructed of a unitary rubber or urethane foam and skin molding and wherein the insole is adhered to upper surfaces of the rim and core.

7. The apparatus of claim 1 wherein the sole and rim are constructed of a unitary rubber or urethane material and wherein the core is joined to the insole and lower surfaces of the core are welded to the rim and sole and peripheral portions of the insole are welded to an upper portion of the rim.

8. The cushion shoe base of claim 1 further comprising a T-shaped rubber or urethane welt for connecting a shoe base to an upper, comprising an integrally formed annular welt having a vertical portion and a horizontal portion extending inward from a medial part of the vertical portion, the vertical portion having a relatively long vertical outer sidewall and a relatively short vertical lower inner wall extending from a bottom of the vertical portion to a lower wall of the horizontal portion, and the vertical portion having a second relatively short inner wall extending from a top of the vertical portion downward to an upper wall of the horizontal portion, means cooperating with the first inner wall for joining the first inner wall to the shoe base, means cooperating with the lower wall of the horizontal portion for joining the lower wall to a horizontal wall on the shoe base, and means cooperating with the second relatively short vertical wall and the upper wall of the horizontal portion for joining those walls to a shoe upper.

9. The cushion shoe base of claim 1 wherein the core is formed of a resilient open cell material.

10. The cushion shoe base of claim 1 wherein partitions extend across the sole dividing the shoe base and the core into sections.

* * * * *